United States Patent [19]

Potvin

[11] 4,300,755

[45] Nov. 17, 1981

[54] MITER BOX CONSTRUCTION WITH CLAMP MEANS

[76] Inventor: Alfred M. Potvin, 5775 Boul. Marie-Victorin, Brossard, Quebec, Canada

[21] Appl. No.: 91,331

[22] Filed: Nov. 5, 1979

[51] Int. Cl.[3] ..... B25B 1/00

[52] U.S. Cl. ..... 269/87.2; 83/762; 269/295

[58] Field of Search ..... 83/761, 762, 454, 455; 145/129; 269/295, 290–291, 87.2, 244, 41

[56] References Cited

U.S. PATENT DOCUMENTS 600,118 3/1898 Brun ..... 269/41

3,397,722 8/1968 Long ..... 83/762

*Primary Examiner*—Robert C. Watson

*Attorney, Agent, or Firm*—Swabey, Mitchell, Houle, Marcoux & Sher

[57] ABSTRACT

A miter box comprising a rectangular bottom wall having a flat top surface. Opposed vertical side walls extend from opposite longitudinal end edges of the bottom wall and are provided with the usual angular and transverse slots. Improvement consists in the provision of clamps which are displaceable between the vertical side walls to apply clamping pressure against the workpiece lying on the top surface of the bottom wall to clamp the workpiece against one of the side walls to keep it in place when making a miter cut.

3 Claims, 4 Drawing Figures

MITER BOX CONSTRUCTION WITH CLAMP MEANS

BACKGROUND OF THE INVENTION

1. Field of the Invention

The present invention relates to an improved mitre box construction having clamping means to hold a workpiece clamped within the box whereby accurate mitre cuts can be made.

2. Description of Prior Art

Various types of mitre box constructions are known. The majority of the boxes known do not provide any means to clamp a workpiece in position whereby to prevent the workpiece from moving while a saw blade is moved thereover on a fixed planar axis. All of the known boxes utilize a means to guide the saw blade and restrain it on specific angles relative to the workpiece and the user usually applies clamping pressure on the workpiece by placing the hand or the thumb over the workpiece and biasing it against one of the vertical side walls while moving the saw with the other hand. The problem which arises is that as the saw is withdrawn, after making a forward cut on the workpiece, it usually displaces the workpiece as the teeth of the saw engage the workpiece and pull it away from the vertical side walls that it is pressed against. Therefore, it is necessary to reposition the workpiece with the cut aligned with the slots in the mitre box. This procedure is time-consuming and does not permit precise cuts in the workpiece as the realignment is not always accurate.

SUMMARY OF THE INVENTION

It is a feature of the present invention to overcome the above-mentioned disadvantages of the prior art by providing an improved mitre box with clamping means to removably secure a workpiece therein.

A further feature of the present invention is to provide a mitre box construction having clamping means in opposed ends thereof to hold a workpiece therein to permit accurate saw blade cuts to be made.

A further feature of the present invention is to provide a mitre box construction having clamping means permitting various uses of the box other than for making mitre cuts in workpieces.

According to the above features, from a broad aspect, the present invention provides a mitre box comprising a rectangular bottom wall having a flat top surface. Opposed vertical side walls extend from opposite longitudinal end edges of the bottom wall. Clamping means is independently displaceable between the vertical side walls to apply clamping pressure on a workpiece lying on the top surface against either one of the side walls. The clamping means has a flat clamp plate having opposed clamping surfaces and extending transversely above the top surface with the clamping surfaces extending parallel to the side walls. A threaded bolt extends across the opposed vertical side walls and is axially rotatable relative thereto. The bolt is in threaded engagement with a threaded bore in the clamp plate and is disposed below the flat top surface. A flat plank is secured on the flat top surface intermediate the ends of the rectangular bottom wall. A clamp plate is provided adjacent each end edge of this plank and extends above a flat top surface thereof. The threaded bolt of each clamp plate extends above the rectangular bottom wall top surface and below the plank top surface.

BRIEF DESCRIPTION OF THE DRAWINGS

A further embodiment of the present invention will now be described with reference to the accompanying drawings in which.

DESCRIPTION OF PREFERRED EMBODIMENT

Figure 1:
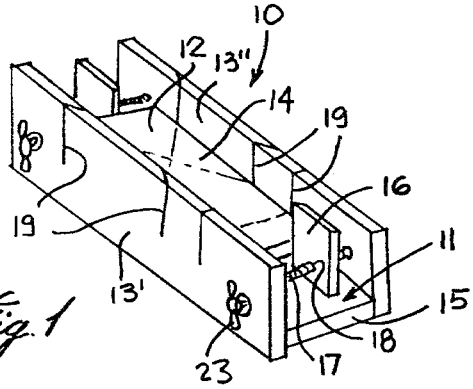
FIG. 1 is a perspective view of the mitre box construction of the invention.

Referring now to the drawings, more particularly to FIG. 1, there is shown generally at 10 the mitre box construction of the present invention. The box comprises a rectangular bottom wall 11 having a flat top surface 12. As herein shown, the flat top surface 12 is constituted by a plank 14 positioned intermediate the ends 15 of the bottom wall 11, for purposes which will be described later. Opposed vertical side walls 13' and 13'' extend from opposite longitudinal end edges of the bottom wall 11.

Clamping means in the form of a clamp shoe 16 herein constituted by a flat clamp plate of rectangular contour, is provided adjacent the end edges 15 of the bottom wall 11. A threaded bolt 17 extends across the opposed vertical side walls 13' and 13'' and is axially rotatable relative thereto. The bolt is also in threaded engagement with a threaded bore 18 in the lower part of the clamp plate 16.

Figure 4:
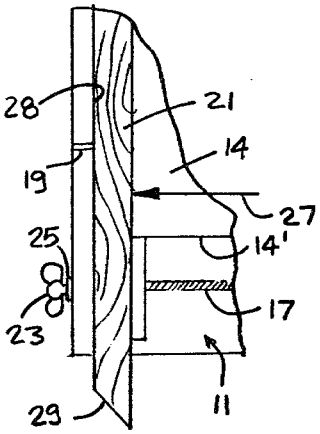
FIG. 4 is a fragmented top end view of the mitre box showing the clamping means in use.
Figure 2:
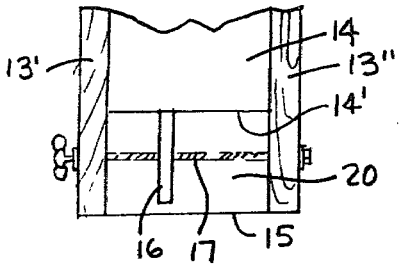
FIG. 2 is a fragmented top end view of the mitre box showing the clamping means.
Figure 3:
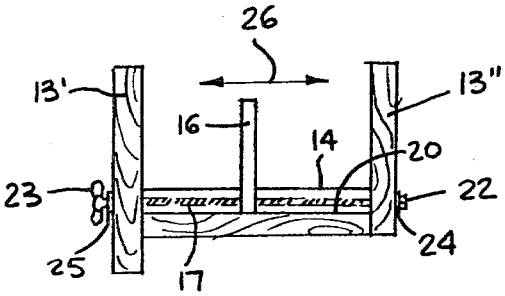
FIG. 3 is an end view of the mitre box.

Referring now additionally to FIGS. 2 to 4, it can be seen that the plank 14 defines a recessed portion 20 between the end edge 14' of the plank and the end edge 15 of the bottom wall 11. As clearly shown in FIG. 3, the threaded bolt 17 is positioned below the top surface 12 of the plank 14 whereby to lie below a workpiece 21 placed on the top surface 12 not to interfere therewith.

The bolt 17 extends through axially aligned holes in respective ones of the side walls 13' and 13'' and is freely rotatable therein. The bolt 17 is secured within these holes (not shown) by an end nut 22 and movably secured to the end of the bolt and a wing head 23 at the opposite end of the bolt to permit axial rotation of the bolt. Washers 24 and 25 are positioned between the end nut 22 and wing head 23 respectively. Thus, by rotating the bolt 17 the clamp plate 16 will be displaced in either direction, as illustrated by arrow 26. The purpose of the clamp plate is to apply clamping pressure on the workpiece 21, see FIG. 4, against at least one of the side walls 13' and 13''. As shown in FIG. 4 the clamping pressure is in the direction of arrow 27 maintaining the workpiece 21 firmly against the inner surface 28 of the side wall 13'. It can be seen that, since both clamp plates 16 are movable in either direction across the side walls 13' and 13'' and operate independently from one another, two workpieces may be clamped against a respective one of the side walls 13' and 13'' or against a respective portion of a common one of the side walls.

As shown in FIG. 1 there are two clamping plates positioned adjacent each end of the mitre box 10 whereby the workpiece 21 is clamped on opposed sides. This permits accurate mitre cuts, such as that shown at 29 to be made, as the workpiece 21 is not displaced by the forward and back strokes of a saw moving through the saw blade slots 19 as are conventional in mitre box constructions.

It is within the ambit of the present invention to provide any obvious modifications of the embodiment shown herein. For example, instead of having a separate plank 14 on the bottom wall 11, the bottom wall may be constructed with channels to receive the bolt 17 therein and guide a lower edge of the clamp plate 16. Also, the clamp plate may be of various configurations. Still further, the clamp plate may be used for clamping other types of workpieces not necessitating mitre cuts but requiring rigid clamping of a workpiece for other purposes. Still furthermore, the clamps 16 may be used for glueing end edges of workpieces whereby to apply clamping pressure between the workpiece after glue has been applied between them.

I claim:

1. A mitre box comprising a rectangular bottom wall having a flat top surface, opposed vertical side walls extending from opposite longitudinal end edges of said bottom wall, and clamping means independently displaceable between said vertical side walls to apply clamping pressure on a workpiece lying on said top surface against either one of said side walls, said clamping means having a flat clamp plate having opposed clamping surfaces and extending transversely above said top surface with said clamping surfaces parallel to said side walls, a threaded bolt extending across said opposed vertical side walls and axially rotatable relative thereto, said bolt being in threaded engagement with a threaded bore in said clamp plate and being disposed below said flat top surface, and a flat plank secured on said flat top surface intermediate the ends of said rectangular bottom wall, there being a clamp plate adjacent each end edge of said plank and extending above a flat top surface thereof, said threaded bolt of each clamp plate extending above said rectangular bottom wall top surface and below said plank top surface.

2. A mitre box as claimed in claim 1, wherein said clamp plate has a straight bottom edge displaceable along a recessed portion of said top surface of said bottom wall extending between said vertical side walls.

3. A mitre box as claimed in claim 2, wherein a clamp plate is provided adjacent each end of said bottom wall.

* * * * *